US008925430B2

(12) United States Patent
Huang

(10) Patent No.: US 8,925,430 B2
(45) **Date of Patent: *Jan. 6, 2015**

(54) TORSION ASSEMBLY WITH WIRELESS DISPLAYERS FOR SIMULTANEOUSLY RECEIVING TORSION DATUM AND DISPLAYING THEREON

(75) Inventor: Kuang-Hsin Huang, Taichung (TW)

(73) Assignee: Taken Etorque Technology Co., Ltd., Taichung (TW)

( * ) Notice: Subject to any disclaimer, the term of this patent is extended or adjusted under 35 U.S.C. 154(b) by 766 days.

This patent is subject to a terminal disclaimer.

(21) Appl. No.: 13/196,892

(22) Filed: Aug. 3, 2011

(65) Prior Publication Data

US 2012/0079923 A1 Apr. 5, 2012

(30) Foreign Application Priority Data

Sep. 30, 2010 (TW) ..... 99218919 U
Oct. 28, 2010 (TW) ..... 99220832 U

(51) Int. Cl.
*B25B 23/14* (2006.01)
*B25B 23/151* (2006.01)
*B25B 23/142* (2006.01)

(52) U.S. Cl.
CPC ..... *B25B 23/1425* (2013.01)
USPC ..... 81/467; 81/468; 81/469; 81/470

(58) Field of Classification Search
CPC .... B25B 23/14; B25B 23/145; B25B 23/151; B25B 23/144; B25B 23/159
USPC ..... 81/467–470, 479
See application file for complete search history.

(56) References Cited

U.S. PATENT DOCUMENTS 8,091,438 B1 * 1/2012 Huang ..... 73/862.23

* cited by examiner

*Primary Examiner* — Monica Carter
*Assistant Examiner* — Danny Hong

(57) ABSTRACT

A torsion assembly includes a torsion tool and at least one wireless displayer for simultaneously receiving and displaying the torsion datum from the torsion tool. The torsion tool includes a seat disposed therein and a display module detachably received in the seat. The wireless displayer includes a base and a body rotatably mounted on the base. The base can be put on a desktop or adhered on a machine by a magnet. The body can wirelessly receive and shown the torsion datum from the first wireless transceiver that is disposed in the seat on the torsion tool.

20 Claims, 7 Drawing Sheets

TORSION ASSEMBLY WITH WIRELESS DISPLAYERS FOR SIMULTANEOUSLY RECEIVING TORSION DATUM AND DISPLAYING THEREON

BACKGROUND OF THE INVENTION

1. Field of the Invention

The present invention relates to a torsion assembly, and more particularly to a torsion assembly that includes a torsion tool and at least one wireless displayer for simultaneously receiving and displaying the torsion datum from the torsion tool.

2. Description of Related Art

In early stages, all the conventional torsion tools are mechanical such that the operator determines whether the operating torsion is reached to the preinstall torsion value or not by all-or none principle. Consequently, the operator can not understand the change of the torsion during operation. As a result, a lighting element or a voice element is disposed on the torsion wrench for alarming the operator when the operating torsion value reaches the pre-installed torsion value. However, the lighting element and the voice element can not indeed alarm the operator when the operator is distracted. In addition, the conventional torsion tool has no display module or the display module is fixed such that the operator can not easily read the operating torsion value during operating the conventional torsion tool.

The present invention has arisen to mitigate and/or obviate the disadvantages of the conventional torsion tools.

SUMMARY OF THE INVENTION

The main objective of the present invention is to provide an improved torsion assembly that includes a torsion tool and at least one wireless displayer for simultaneously receiving and displaying the torsion datum from the torsion tool.

To achieve the objective, the torsion tool includes a seat disposed therein. The seat includes a micro-processor and a sensor respectively disposed therein, wherein the sensor is electrically connected to the micro-processor. The sensor is provided for sensing the variation of the torsion from the torsion tool and transmitting an analogy signal of the torsion variation to the micro-processor. A first wireless transceiver, a switch and a first contact element are respectively electrically connected to the micro-processor. A display module is detachably received in the seat for showing torsion datum. The display module includes a micro-controller disposed therein and a second contact element electrically connected to the micro-controller, wherein the second contact element is selectively and electrically connected to the first contact element for directly receiving the signals from the seat when the display module is received in the seat. Multiple function keys are mounted onto a front panel of the display module and respectively connected to the micro-controller for installing torsion value and change display mode of the display module. A power set is disposed in the display module and electrically connected to the micro-controller for providing power to the display module when being detached from the seat. A power set is disposed in the torsion tool and electrically connected to the seat for provide power to the seat and selectively providing power to the display module.

The wireless displayer includes a base a body rotatably mounted on the base for wirelessly receiving and displaying the torsion datum form the first wireless transceiver during operating. The body includes a micro-processor and a wireless receiver respectively installed in the body and electrically connected to each other, wherein the wireless receiver is provided to wirelessly receive the torsion datum from the first wireless transceiver and transmits the received torsion datum to the micro-processor of the body. Multiple function keys are respectively disposed on the body for operator to change the display mode and function of the wireless displayer.

Further benefits and advantages of the present invention will become apparent after a careful reading of the detailed description with appropriate reference to the accompanying drawings.

DETAILED DESCRIPTION OF THE INVENTION

Figure 1:
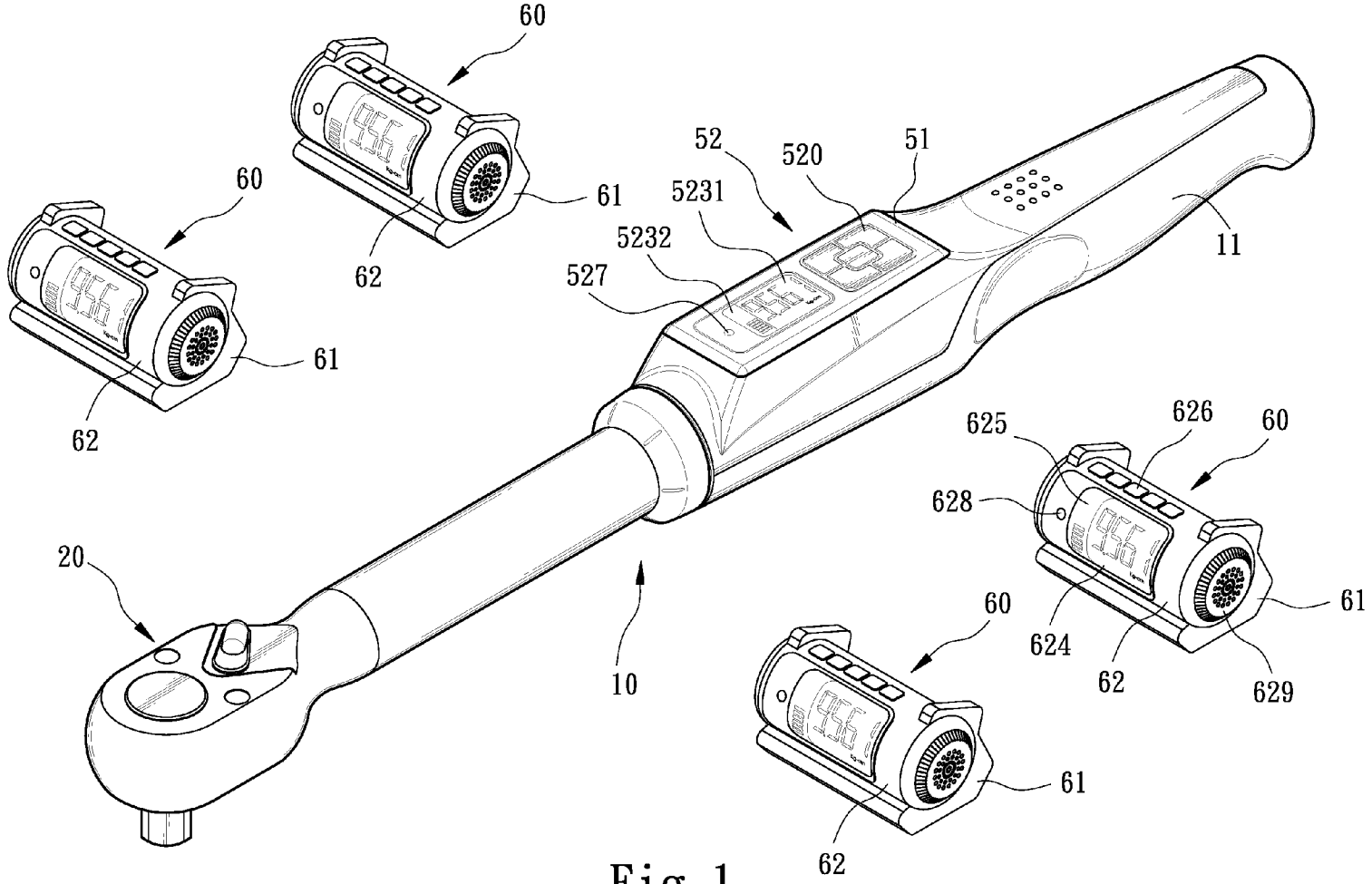
FIG. 1 is a perspective view of a torsion assembly in accordance with the present invention.
Figure 2:
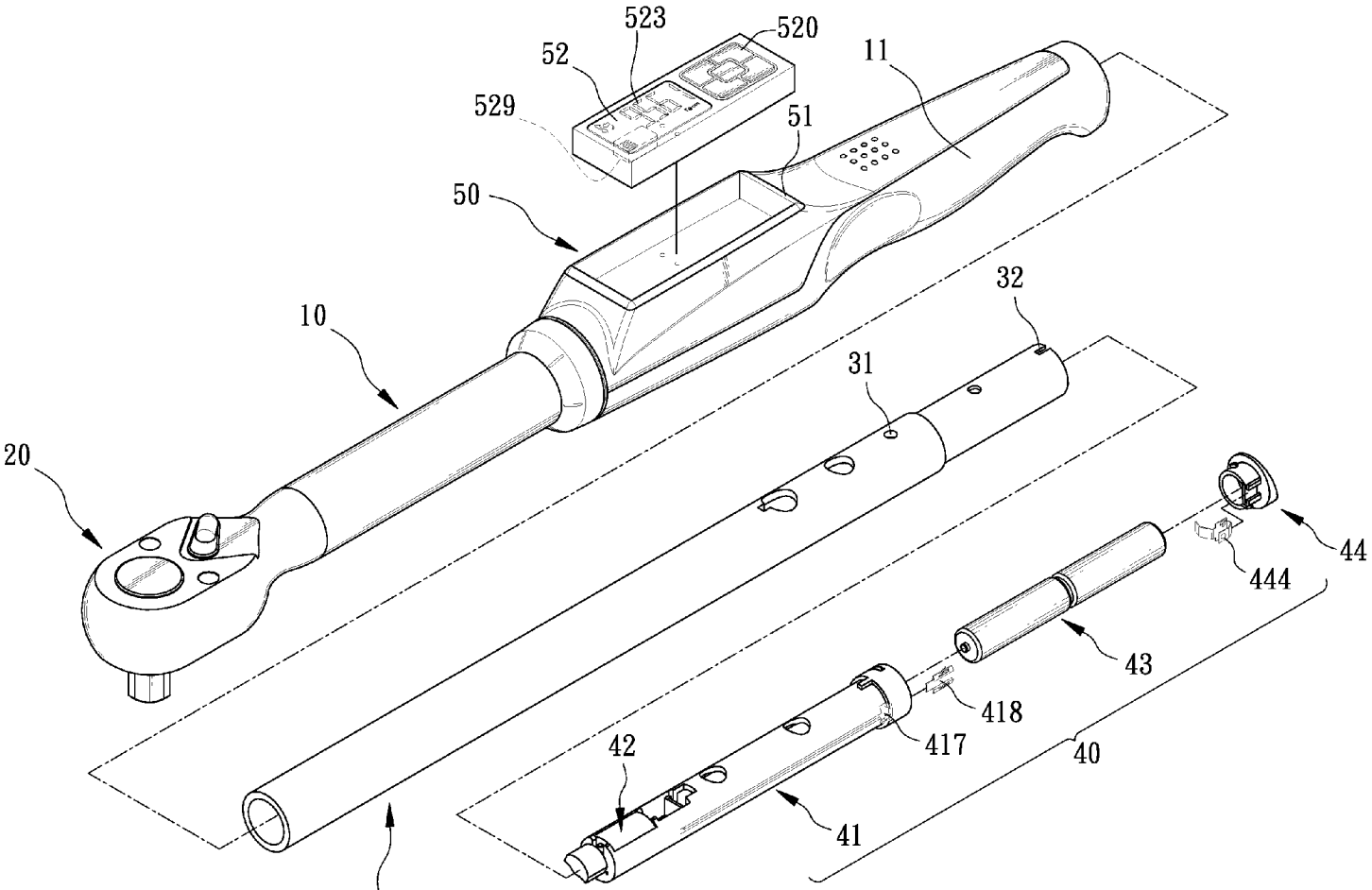
FIG. 2 is an exploded perspective of a torsion tool of the torsion assembly in accordance with the present invention.

Referring to the drawings and initially to FIGS. 1 and 2, a torsion assembly in accordance with the present invention comprises a torsion tool (10) and at least one wireless displayer (60) for receiving torsion datum and displaying thereon.

In the preferred embodiment of the present invention, the torsion tool (10) is a torsion wrench that includes a first end having a ratchet operator (20) disposed thereon and a metal tube (30) inserted into a second end of the torsion tool (10). A vibrating device (40) is mounted in the metal tube (40). The vibrating device (40) is operated when the operate torsion reach a pre-set value and the vibration is transmitted to the operator's palm for providing an alarm to the operator and prevent from an over operation. A grip (11) is sleeved on the second end of the torsion wrench (10) and a seat (51) is disposed in the grip (11). A display module (52) is detachably received in the seat (51) and the display module (52) wirelessly receives the signals form the seat (51).

Figure 3:
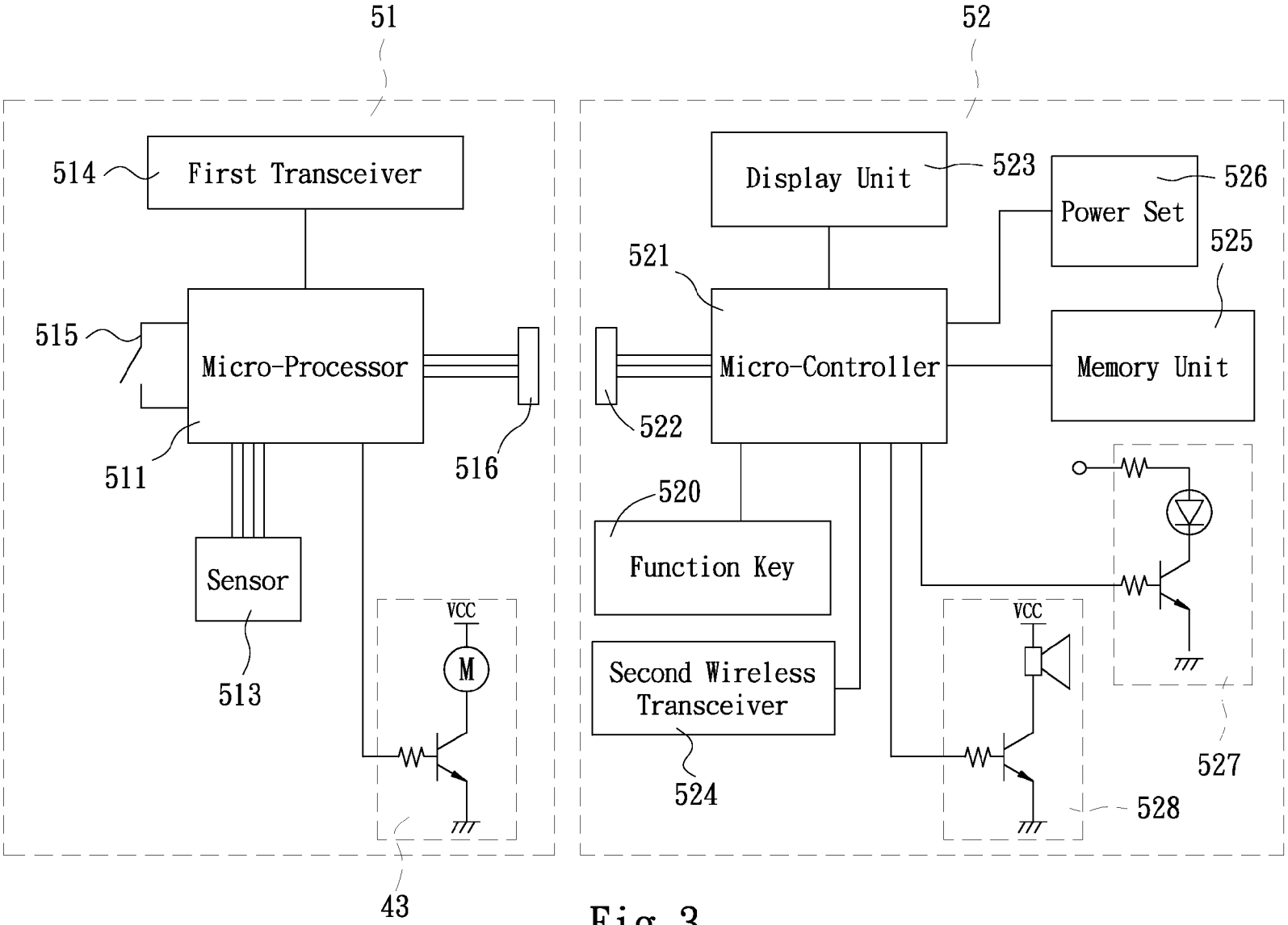
FIG. 3 is a circuit schematic view of a seat and a display module of the torsion tool as shown in FIG. 1.

With reference to FIGS. 2 and 3, the seat (51) includes a micro-processor (511) and a sensor (513) disposed therein, wherein the sensor (513) is electrically connected to the micro-processor (511). The sensor (513) is provided for sensing the variation of the torsion from the torsion tool (10) and transmitting an analogy signal of the torsion variation to the micro-processor (511). A first wireless transceiver (514) and a switch (515) are respectively electrically connected to the micro-processor (511), wherein the first wireless transceiver (514) transmits signals to the display module (52) when the display module (52) is detached from the seat (51). In addition, the seat (51) includes a first contact element (516) electrically connected to the micro-processor (511).

The display module (52) includes a micro-controller (521) disposed therein and a second contact element (522) electrically connected to the micro-controller (521), wherein the second contact element (522) is selectively and electrically connected to the first contact element (516) for directly receiving the signals from the seat (51). A display unit (523)

and multiple function keys (520) are mounted onto a front panel of the display module (52) and respectively electrically connected to the micro-controller (521). The display unit (523) is provided to shown torsion datum, such as timing torsion value, and the function keys (520) are provided to install torsion value or change display mode. In the preferred embodiment of the present invention, the display unit (523) is an LCD displayer. A second wireless transceiver (524) is disposed in the display module (52) and electrically connected to the micro-controller (521) for receiving the torsion datum from first wireless transceiver (514) in the seat (51) and transmitting install datum to the micro-processor (511) via the first wireless transceiver (514) when the display module (52) is separated from the seat (51). Further with reference to FIG. 1, the display unit (523) is divided into a numeral zone (5231) for showing the torsion value by numbers and a pattern zone (5232) for showing the ratio of the pre-set torsion value and timing torsion value. A memory unit (525) is disposed in the display module (52) and electrically connected to the micro-controller (521). The memory unit (525) is provided to remember establish parameters and torsion values. A power set (526) is disposed in the display module (52) and electrically connected to the micro-controller (521). The display module (52) directly uses the power from the seat (51) and some power from the seat (51) is saved in the power set (526) when the first contact element (516) is electrically connected to the second contact element (522). The display module (52) uses the power from the power set (526) and continually works when the display module (52) is separated from the seat (51). A light alarm element (527) and a sound alarm element (528) are respectively disposed in the display module (52) for warning the operator and preventing from an over operation when the operate torsion is reached the pre-set torsion value. In addition, a magnet (529) is mounted into a bottom of the display module (52) such that the display module (52) can be easily adhered to the machine or the workpiece for operator to easily read the torsion value during operating.

The metal tube (30) includes multiple through holes (31) defined therein and multiple indentations (32) defined in a distal end thereof and corresponding to the grip (11).

Figure 4:
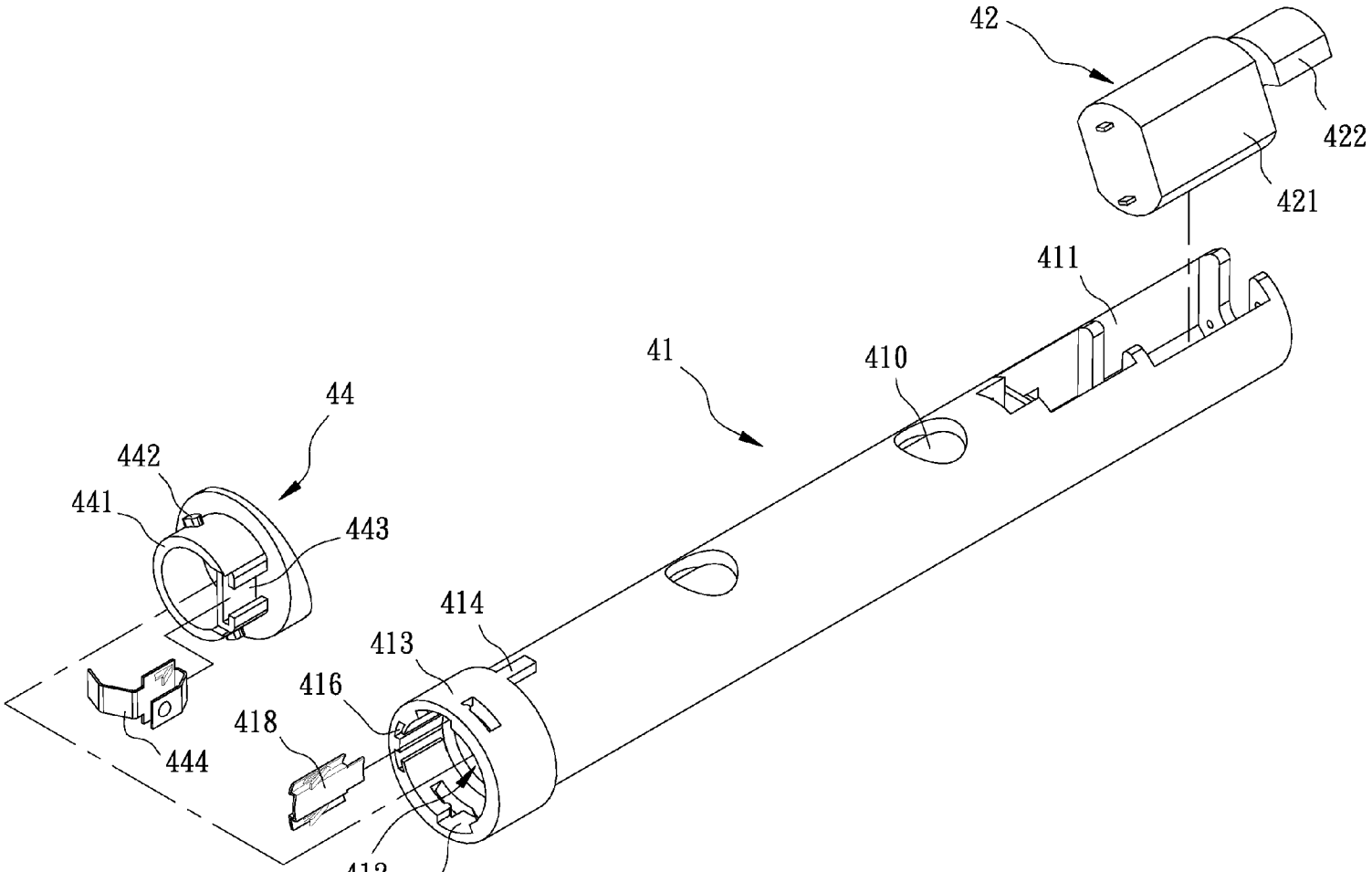
FIG. 4 is an exploded perspective view of a vibrating device of the torsion tool as shown in FIG. 1.
Figure 5:
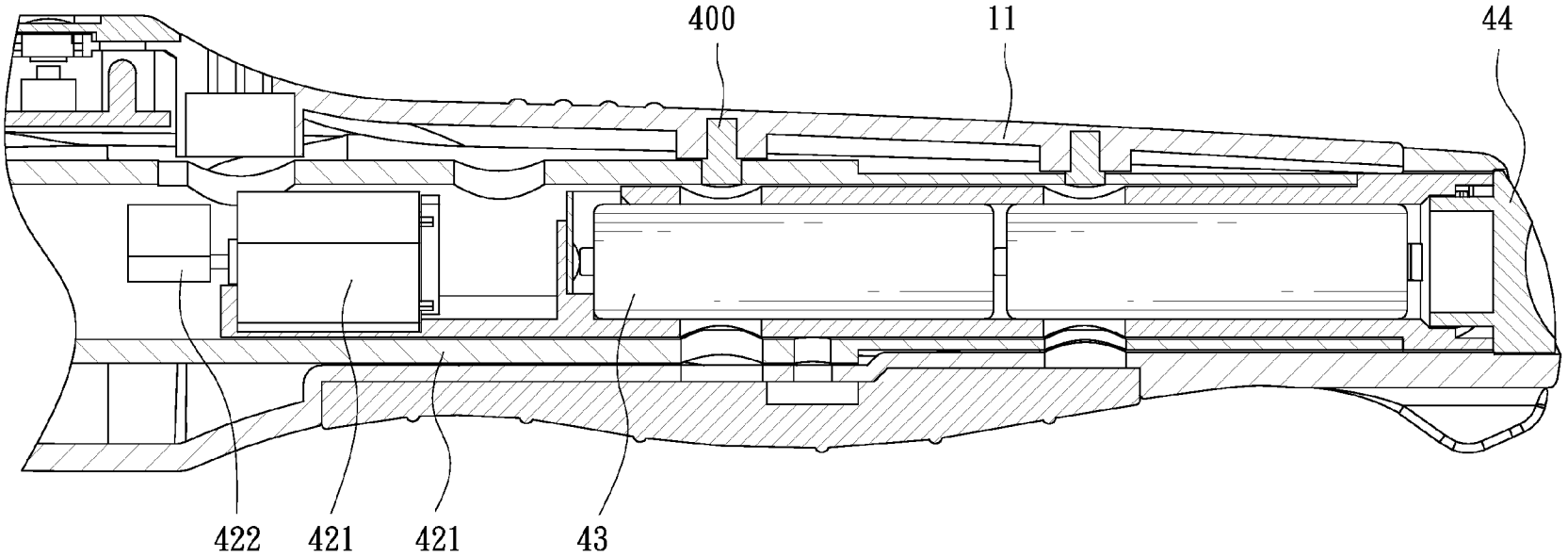
FIG. 5 is a first cross-sectional view of the vibrating device of torsion tool as shown in FIG. 1.
Figure 6:
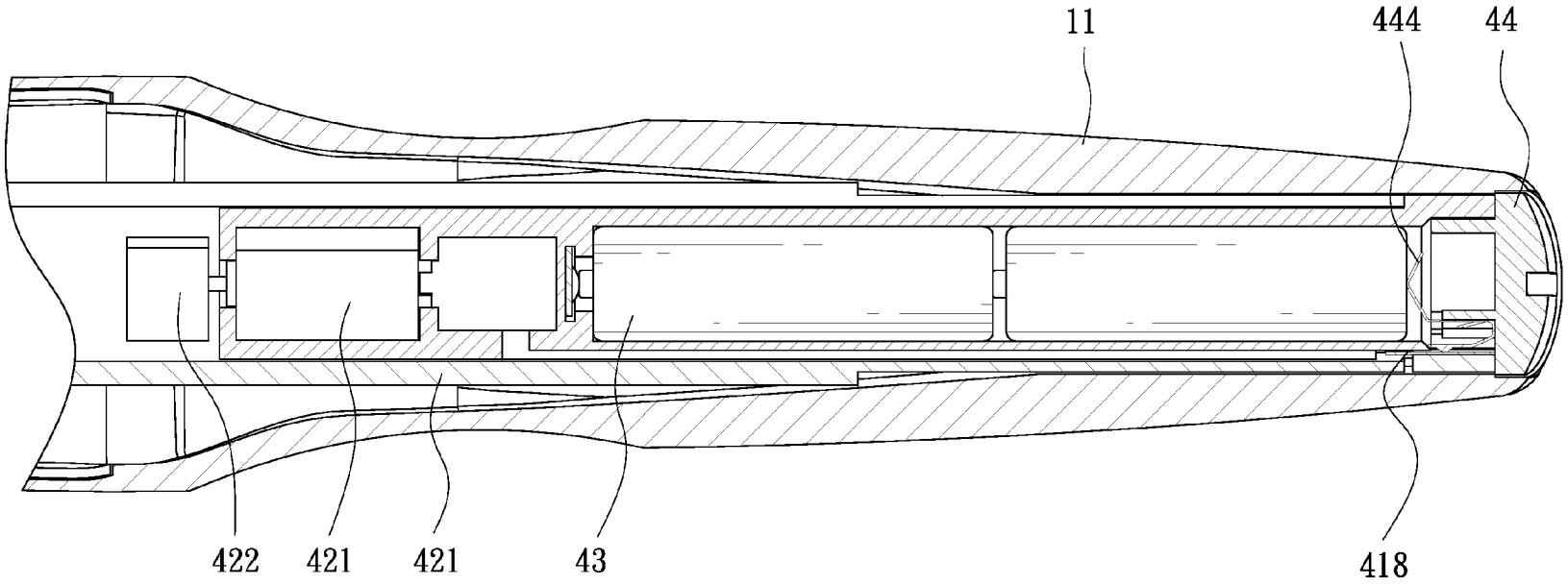
FIG. 6 is a second cross-sectional view of the vibrating device of torsion tool as shown in FIG. 1.
Figure 7:
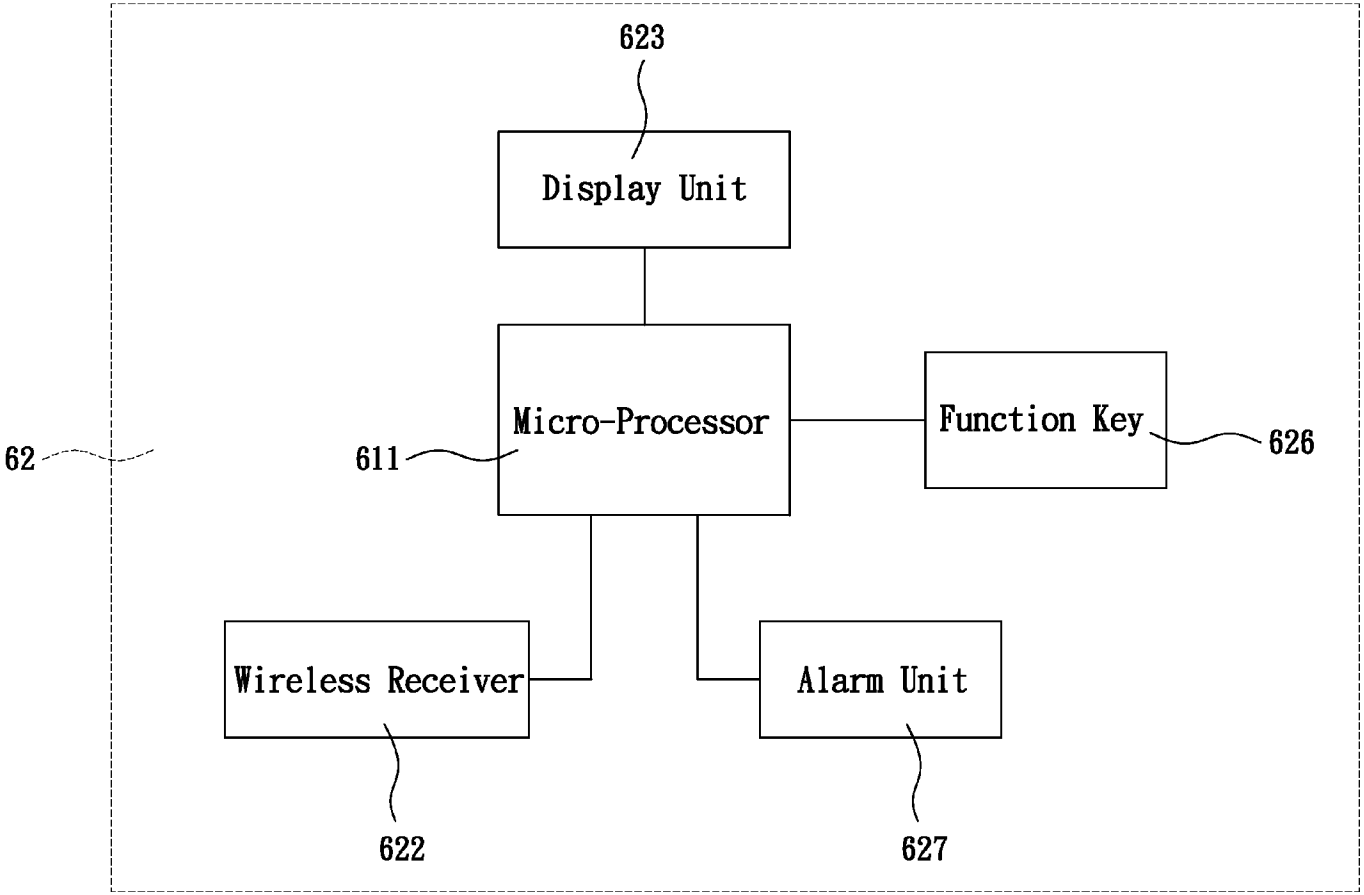
FIG. 7 is a circuit schematic view of the wireless displayer as shown in FIG. 1.

With reference to FIGS. 2, 4 and 5, the vibrating device (40) includes an inner tube (41) fixedly inserted into the metal tube (30). A motor set (42) is received in a front end of the inner tube (41) and a power set (43) is received in the inner tube (41), wherein the power set (43) is electrically connected to the motor set (42). An end cap (44) is detachably mounted onto a rear end of the inner tube (41) for closing the grip (11) and preventing the power set from falling from the inner tube (41). The power set (43) is electrically connected to the micro-processor (511) for providing the energy to the seat (51) and the display module (52).

The inner tube (41) has a trough (411) defined in the front thereof for receiving the motor set (42) and a tunnel (412) longitudinally defined therein for receiving the power set (43), wherein the tunnel (412) is communicated with the trough (411). A shoulder (413) is formed on the rear end of the inner tube (41). The shoulder (413) has multiple tenons (414) extending therefrom and each tenon (414) is engaged into a corresponding one of the indentations (32) for prevent the inner tube (41) from rotating relative to the metal tube (30). The inner tube (41) has multiple through hole (410) defined therein, wherein each through hole (410) in the inner tube (41) communicates with a corresponding one of the through hole (31) in the metal tube (30) after the inner tube (41) inserted into the metal tube (30) and each tenon (414) extending into the corresponding indentation (32). A locking member (400) is securely received in the communicated through holes (410, 31) for holding the inner tube (41) in place in the metal tube (30). Multiple L-shaped grooves (415) and a pair of grooves (416) are respectively defined in an inner periphery of the inner tube (41) and correspond to the shoulder (413). An opening (417) is defined in the shoulder (413) and extends into the inner periphery of the inner tube (41). A first contact plate (418) has two opposite sides respectively slid into the pair of grooves (416). The first contact plate (418) has one end extending through the opening (417) and is electrically connected to the metal tube (30).

The motor set (42) has a motor (421) received in the trough (411) and electrically connected to a first electrode of the power set (43). A counterweight (422) is eccentrically connected to the motor (421), such that the motor set (42) forms vibration for warning the operator when the motor (421) is operated. The power set (43) is received in the tunnel (412).

The end cap (44) includes a hollow stub (441) longitudinally extending therefrom and multiple buckles (442) formed on an outer periphery of the hollow stub (441), wherein each buckle (442) is engaged into a corresponding one of the multiple L-shaped grooves (415) for holding the end cap (44) in place. A T-shaped groove (443) is laterally defined in the hollow stub (441) and a second contact plate (444) is securely inserted into the T-shaped groove (443). The second contact plate (444) is respectively electrically connected the first contact plate (418) and a second electrode of the power set (43) for transmitting the energy from the power set (43) to the motor set (42).

With reference to FIG. 1, each wireless displayer (60) includes a base (61) and a body (62) rotatably mounted on the base (61). The base (61) can be put on a desktop or adhered on a machine by a magnet (not shown). The body (62) can wirelessly receive torsion datum from the first wireless transceiver (514) of the seat (51) on the torsion tool (10).

A micro-processor (621) and a wireless receiver (622) are respectively installed in the body (62) and electrically connected to each other, wherein the wireless receiver (622) is provided to wirelessly receive the torsion datum from the first wireless transceiver (514) and transmits the received torsion datum to the micro-processor (621). A display unit (623) is mounted onto the body (62) and electrically connected to the micro-processor (621) for showing the torsion value. The display unit (623) is divided into a numeral zone (624) for showing the torsion value by numbers and a pattern zone (625) for showing the ratio of the pre-set torsion value and the timing torsion value. In addition, the numeral zone (624) shows time and used as an electric clock when being idle relative to the torsion tool (10). The body (62) can be axially rotated to adjust the visual angle of the display unit (623) for user to easily read the numeral shown on the display unit (623). Multiple function keys (226) are disposed on the body (62) for user to change the display types and functions of the display unit (623). An alarm unit (627) is disposed on the body (62) and electrically connected to the micro-processor (621). The alarm unit (627) includes a light alarm (628) and a sound alarm (629) respectively mounted onto an outer periphery of the body (62) for alarming the operator via light and sound. In the preferred embodiment of the present invention, the light alarm (628) in an LED and the sound alarm (629) is a buzzer.

When using the torsion assembly in accordance with the present invention, the torsion value is firstly installed by using the function keys (520) on the display module (52). The display module (52) will send a signal to make the motor set (42) being operated for warning the operator and prevent an over operation when the timely operating value reaches the preinstalled torsion value and the operator is distracted. At the same time, the light alarm element (527) and the sound alarm element (528) of the display module (52) are operated for warning the operation by different ways.

In a normal operation, the display module (52) is received in the seat (51) and the first contact element (516) and the second contact element (522) are electrically connected to each other such that the energy from the power set (43) of the motor set (43) is partially saved in the power set (526) in the display module (52). In addition, the operating datum are directly transmitted to the display module (52) via the connected first contact element (516) and the second contact element (522), and then, the first wireless transceiver (514) and the second wireless transceiver (524) are turned off for saving power.

When the operating angle is inconvenient for operating to read the data shown on the display module (52) in the seat (51), the display module (52) can be detached from the seat (51) and adhered on the machine or the workpiece by the magnet (529) on the display module (52) for operator to easily read the numeral from the display module (52). The power supply of the micro-controller (521) of the display module (52) is automatically cut off for saving power when the torsion assembly (10) has been idle for a period of time. The micro-controller (521) is waked up when the switch (515) is pressed again.

Another characteristic of the present invention is the multiple wireless displayers (60). When training a newcomer who is inexperienced in operating a torsion tool, the multiple wireless displayers (60) are distributed to his/her chiefs and trainers. Consequently, the chiefs and the trainer can immediately understand the sensitivity and skill of the operator about torsion variation.

Although the invention has been explained in relation to its preferred embodiment, it is to be understood that many other possible modifications and variations can be made without departing from the spirit and scope of the invention as hereinafter claimed.

What is claimed is:

1. A torsion assembly comprising a torsion tool and at least one wireless display for simultaneously receiving and displaying torsion datum from the torsion tool during operation, wherein:

the torsion tool includes:

a seat disposed therein, the seat including a micro-processor and a sensor respectively disposed therein, wherein the sensor is electrically connected to the micro-processor, the sensor configured to sense variation of torsion from the torsion tool and transmitting an analog signal of the torsion variation to the micro-processor, a first wireless transceiver, a switch and a first contact element respectively electrically connected to the micro-processor;

a display module detachably received in the seat for showing torsion datum, the display module including a micro-controller disposed therein and a second contact element electrically connected to the micro-controller, wherein the second contact element is selectively and electrically connected to the first contact element for directly receiving the signals from the seat when the display module is received in the seat, multiple function keys mounted onto a front panel of the display module and respectively connected to the micro-controller for inputting a torsion value and change display mode of the display module, a power set disposed in the display module and electrically connected to the micro-controller for providing power to the display module when detached from the seat; and a power set disposed in the torsion tool and electrically connected to the seat for providing power to the seat and selectively providing power to the display module; and the wireless display includes:

a base; and a body rotatably mounted on the base for wirelessly receiving and displaying the torsion datum form the first wireless transceiver during operation, the body including a micro-processor and a wireless receiver respectively installed in the body and electrically connected to each other, wherein the wireless receiver is provided to wirelessly receive the torsion datum from the first wireless transceiver and transmit the received torsion datum to the micro-processor of the body, multiple function keys respectively disposed on the body for changing a display mode and function of the wireless display.

2. The tool assembly as claimed in claim 1, wherein the wireless display includes a display unit mounted onto the body thereof and electrically connected to the micro-processor of the wireless display for showing the torsion value.

3. The tool assembly as claimed in claim 2, wherein the display unit of the wireless display is divided into a numeral zone for showing the torsion value by numbers numerically and a pattern zone for showing a ratio of a pre-set torsion value and a timing torsion value.

4. The torsion assembly as claimed in claim 1, wherein the display module of the torsion tool includes a display unit mounted onto the front panel of the display module of the torsion tool for showing the datum from the seat.

5. The torsion assembly as claimed in claim 4, wherein the display unit of the display module of the torsion tool is divided into a numeral zone for showing the torsion value numerically and a pattern zone for showing a ratio of a pre-set torsion value and a timing torsion value.

6. The torsion assembly as claimed in claim 1, wherein the display module of the torsion tool includes a second wireless transceiver disposed therein and electrically connected to the micro-controller for receiving the torsion datum from the first wireless transceiver when the display module is separated from the seat.

7. The torsion assembly as claimed in claim 1, wherein the display module of the torsion tool includes a power set disposed therein and electrically connected to the micro-controller, the display module of the torsion tool directly using power from the power set of the seat and some power from the power set of the seat being saved in the power set of the display module of the torsion tool when the first contact element is electrically connected to the second contact element, and the display module of the torsion tool uses the power from the power set thereof and continues operating when the display module of the torsion tool is separated from the seat.

8. The torsion assembly as claimed in claim 1, wherein the display module of the torsion tool includes a light alarm element and a sound alarm element respectively disposed therein for operational warnings and preventing an over operation when the operating torsion reaches a pre-set torsion value.

9. The torsion assembly as claimed in claim 1, wherein the display module of the torsion tool includes a magnet mounted into a bottom thereof such that the display module can be coupled to a machine or a workpiece for viewing of the torsion value during operations.

10. The torsion assembly as claimed in claim 2, wherein the display module of the torsion tool includes a display unit mounted onto the front panel of the display module of the torsion tool for showing the datum from the seat.

11. The torsion assembly as claimed in claim 10, wherein the display unit of the display module of the torsion tool is divided into a numeral zone for showing the torsion value numerically and a pattern zone for showing the ratio of the pre-set torsion value and timing torsion value.

12. The torsion assembly as claimed in claim 2, wherein the display module of the torsion tool includes a second wireless transceiver disposed therein and electrically connected to the micro-controller for receiving the torsion datum from the first wireless transceiver when the display module is separated from the seat.

13. The torsion assembly as claimed in claim 2, wherein the display module of the torsion tool includes a power set disposed therein and electrically connected to the micro-controller, the display module of the torsion tool directly using the power from the power set of the seat and some power from the power set of the seat being saved in the power set of the display module of the torsion tool when the first contact element is electrically connected to the second contact element, and the display module of the torsion tool uses the power from the power set thereof and continues operating when the display module of the torsion tool is separated from the seat.

14. The torsion assembly as claimed in claim 1, wherein the display module of the torsion tool includes a light alarm element and a sound alarm element respectively disposed therein for operational warnings and preventing an over operation when the operating torsion reaches a pre-set torsion value.

15. The torsion assembly as claimed in claim 2, wherein the display module of the torsion tool includes a magnet mounted into a bottom thereof such that the display module can be coupled to a machine or a workpiece for viewing the torsion value during operations.

16. The torsion assembly as claimed in claim 10, wherein the display module of the torsion tool includes a second wireless transceiver disposed therein and electrically connected to the micro-controller for receiving the torsion datum from the first wireless transceiver when the display module is separated from the seat.

17. The torsion assembly as claimed in claim 10, wherein the display module of the torsion tool includes a power set disposed therein and electrically connected to the micro-controller, the display module of the torsion tool directly using power from the power set of the seat and some power from the power set of the seat being saved in the power set of the display module of the torsion tool when the first contact element is electrically connected to the second contact element, and the display module of the torsion tool uses the power from the power set thereof and continues operating when the display module of the torsion tool is separated from the seat.

18. The torsion assembly as claimed in claim 10, wherein the display module of the torsion tool includes a light alarm element and a sound alarm element respectively disposed therein for operational warnings and preventing an over operation when the operating torsion reaches a pre-set torsion value.

19. The torsion assembly as claimed in claim 16, wherein the display module of the torsion tool includes a power set disposed therein and electrically connected to the micro-controller, the display module of the torsion tool directly using the power from the power set of the seat and some power from the power set of the seat being saved in the power set of the display module of the torsion tool when the first contact element is electrically connected to the second contact element, and the display module of the torsion tool uses the power from the power set thereof and continues operating when the display module of the torsion tool is separated from the seat.

20. The torsion assembly as claimed in claim 16, wherein the display module of the torsion tool includes a light alarm element and a sound alarm element respectively disposed therein for operational warnings and preventing an over operation when the operating torsion reaches a pre-set torsion value.

* * * * *